US010648754B2

(12) United States Patent
Sun

(10) Patent No.: US 10,648,754 B2
(45) Date of Patent: May 12, 2020

(54) SYSTEM AND METHOD FOR KEYLESS FIREARM LOCK

(71) Applicant: Jinchuan Sun, Taiyuan (CN)

(72) Inventor: Jinchuan Sun, Taiyuan (CN)

( * ) Notice: Subject to any disclaimer, the term of this patent is extended or adjusted under 35 U.S.C. 154(b) by 0 days.

(21) Appl. No.: 16/555,066

(22) Filed: Aug. 29, 2019

(65) Prior Publication Data

US 2020/0072570 A1 Mar. 5, 2020

(30) Foreign Application Priority Data

Sep. 3, 2018 (CN) ..... 2018 1 1018941

(51) Int. Cl.
*F41A 17/06* (2006.01)

(52) U.S. Cl.
CPC ..... *F41A 17/06* (2013.01)

(58) Field of Classification Search
CPC ..... F41A 17/06; F41A 17/02; F41A 17/04; F41A 17/00; F41A 17/063; F41A 17/066; F41A 17/44
USPC ..... 42/70
See application file for complete search history.

(56) References Cited

U.S. PATENT DOCUMENTS 5,664,358 A * 9/1997 Haber ..... F41A 17/44 42/44
5,699,687 A * 12/1997 Pittman ..... F41A 17/02 42/70.11
5,860,241 A * 1/1999 Waters ..... F41A 17/06 42/66
6,526,684 B1 * 3/2003 Hickerson ..... F41A 17/44 42/70.01
6,560,910 B1 * 5/2003 McLaren ..... F41A 17/04 42/70.11
6,634,130 B1 * 10/2003 Balchunas ..... F41A 17/44 42/70.11
6,701,655 B2 * 3/2004 Milo ..... F41A 17/44 42/70.11
2002/0133999 A1 * 9/2002 Polenz ..... F41A 17/44 42/70.11
2004/0074131 A1 * 4/2004 Meyerle ..... F41A 17/06 42/70.11
2004/0200114 A1 * 10/2004 Milo ..... F41A 17/44 42/70.11

(Continued)

*Primary Examiner* — Joshua E Freeman
(74) *Attorney, Agent, or Firm* — Rosenberg, Klein & Lee

(57) ABSTRACT

A system for keyless locking of a firearm against discharge is provided, which includes a casing configured for removable insert into a barrel of the firearm, and an extension rod disposed in longitudinally displaceable manner therein. The extension rod is provided with first and second ends and an intermediate portion extending longitudinally therebetween. A locking component supported by the casing is displaceable responsive to the extension rod between locked and unlocked positions. A powered driver coupled to the extension rod for selectively drives the displacement thereof responsive to user activation. The locking component in the locked position protrudes transversely beyond the casing for retentively engaging an inner surface of the firearm to prevent removal of the casing from its barrel, and in the unlocked position is retracted to maintain clearance from the inner surface of the firearm to permit removal of the casing from the barrel of the firearm.

16 Claims, 6 Drawing Sheets

(56) References Cited

U.S. PATENT DOCUMENTS

| | | | | |
|---|---|---|---|---|
| 2006/0162221 | A1* | 7/2006 | McLaren | F41A 17/44<br>42/70.11 |
| 2007/0079540 | A1* | 4/2007 | Giebel | F41A 17/063<br>42/70.11 |
| 2017/0184362 | A1* | 6/2017 | Pittman | F41A 17/02 |
| 2018/0094890 | A1* | 4/2018 | Pittman | F41A 17/02 |
| 2018/0259283 | A1* | 9/2018 | Pittman | G04B 99/00 |
| 2019/0170482 | A1* | 6/2019 | Engelstein | F41G 3/2605 |

* cited by examiner

SYSTEM AND METHOD FOR KEYLESS FIREARM LOCK

BACKGROUND OF THE INVENTION

The present invention relates to the field of locks, and in particular to a system and method for establishing a keyless gun lock for firearms, unlocking access to such gun lock, and managing password access thereto.

Firearms are widely usually used in military, police departments, and other public security contexts. Due to the lethality and intrinsic dangers of firearms, the use of firearms needs to be strictly regulated and controlled to avoid abusive uses posing threats to human life. Conventional measures for managing and controlling guns have included gun lock devices for locking the firearms to avoid unauthorized use of the firearm, so that the use of the gun is tightly restricted.

A conventional gun lock is a lock device used for firearm management. Existing mechanical gun locks generally use a key to unlock and lock the given device. A key is not only prone to be deformed or even broken from repetitive use, the key itself has poor anti-theft properties and may be easily lost, and thereby raise its own safety concerns. In an emergency situation, for instance, a lock could not be readily unlocked without the key being not readily available. This would hinder proper authorized operation of the firearm. Also, a mechanical gun lock is not easy to operate in a dark environment.

Moreover, some conventional gun locks operate by locking the trigger of the firearm. The unlocking operation requires removal of an unlocking device, which may be complicated and time consuming. When the firearm is needed for use in an emergency, the complicated unlocking operation would hinder proper authorized operation of the firearm.

There is therefore a need for a gun lock for firearms that is secure yet simple to unlock. There is a need for such a gun lock for firearms that does not require restraining engagement of the firearms' moving parts and obviates the need for physical key for unlocking access.

SUMMARY OF THE INVENTION

Figure 1:
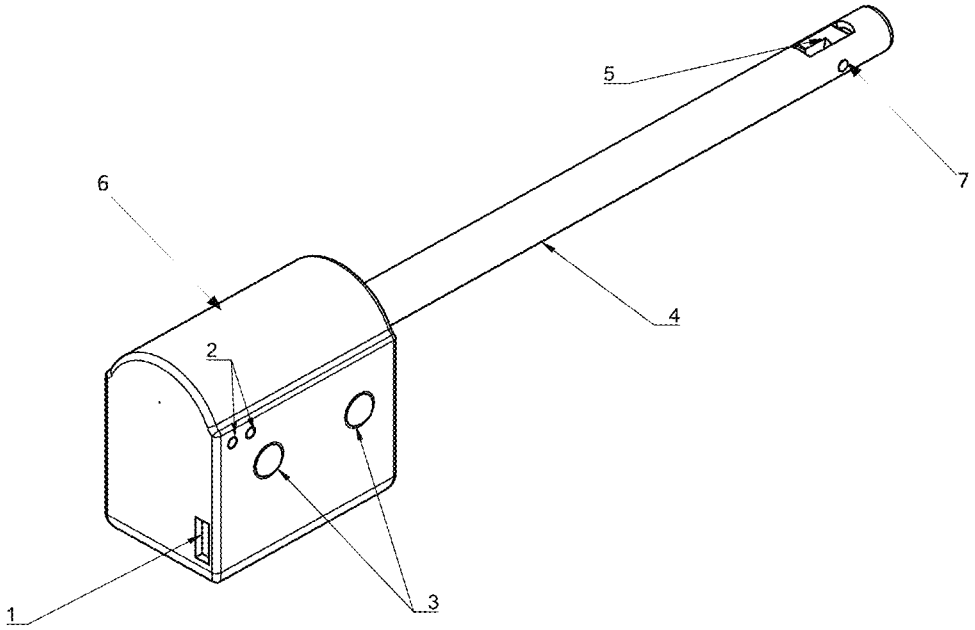
FIG. 1 is a schematic perspective view of a system formed in accordance with one exemplary embodiment of the present invention.

It is an object of the presented invention to provide a system and method for locking firearms that is secure yet simple to unlock.

It is an object of the presented invention to provide such system and method for locking firearms that does not require restraining engagement of the firearms' moving parts.

It is another object of the presented invention to provide a system and method for establishing a keyless gun lock for firearms, which provides simple yet effective unlocking access.

It is yet another object of the presented invention to provide such system and method which generally mitigates problems of complexity and timely access encountered with use of gun locks heretofore known.

These and other objects are attained in a system for keyless locking of a firearm against discharge. The system includes a casing configured for removable insert into a barrel of the firearm, and an extension rod disposed in longitudinally displaceable manner in the casing. The extension rod is provided with first and second ends and an intermediate portion extending longitudinally therebetween. A locking component is supported by the casing to be displaceable responsive to the extension rod between locked and unlocked positions relative the casing. A powered driver is coupled to the extension rod for selectively driving the displacement thereof responsive to user activation. The locking component in the locked position protrudes transversely beyond the casing for retentively engaging an inner surface of the firearm to prevent removal of the casing from the barrel of the firearm. The locking component in the unlocked position is retracted to maintain clearance from the inner surface of the firearm to permit removal of the casing from the barrel of the firearm.

In certain though not necessarily all embodiments, a system for keyless locking of a firearm against discharge includes a casing configured for removable insert into a barrel of the firearm. The casing includes a first outer portion configured to remain outside a barrel of the firearm when the system is installed to lock the firearm, and a second outer portion configured to extend coaxially into the barrel of the firearm when the system is installed to lock the firearm. An extension rod is disposed in axially displaceable manner substantially within the second outer portion of the casing. The extension rod is formed with first and second ends and an intermediate portion extending axially therebetween. A locking component is supported by the casing to be displaceable responsive to the extension rod between locked and unlocked positions relative the casing. A powered driver is disposed in the first outer portion of the casing and coupled to the first end of the extension rod for selectively driving its displacement. A control device is coupled to actuate the powered driver responsive to user activation, which control device executes a processor to selectively issue control commands to the powered driver for driving the locking component between its locked and unlocked positions. The control device is configured for network communication with a remotely disposed device. The locking component in the locked position protrudes transversely beyond the casing for retentively engaging an inner surface of the firearm to prevent removal of the casing from the barrel of the firearm, and the locking component in the unlocked position remains transversely contained within a periphery of the casing for clearance from the inner surface of the firearm to permit removal of the casing from the barrel of the firearm.

In certain though not necessarily all embodiments, a method for keyless locking of a firearm against discharge includes establishing a casing having first and second outer portions, and removably installing the casing from outside the firearm by coaxially inserting the second outer portion thereof into a barrel of the firearm, with the first outer portion thereof remaining outside the barrel of the firearm. An extension rod disposed substantially within the second outer portion of the casing is axially displaced. The extension rod is formed with first and second ends and an intermediate portion extending axially therebetween. A locking component is displaceably supported on the casing to be displaceable responsive to displacement of the extension rod between locked and unlocked positions relative the casing. A powered driver disposed in the first outer portion of the casing is activated to selectively drive axial displacement of the extension rod for actuating displacement of the locking component responsive thereto between the locked and unlocked positions. Access for activation of said powered driver is selectively controlled. The locking component in the locked position is arranged to protrude transversely beyond the casing for retentively engaging an inner surface of the firearm and thereby preventing removal of the casing from the barrel of the firearm, and the locking component in the unlocked position is arranged to remain transversely within a periphery of the casing for clearance from the inner surface of the firearm and thereby permit removal of the casing from the barrel of the firearm.

DETAILED DESCRIPTION OF THE PREFERRED EMBODIMENTS

The technical solutions in accordance with certain aspects of the present invention are clearly and completely described herein with reference to exemplary embodiments and drawings. The described embodiments are only illustrative, and provide but a subset of the all the various embodiments of the present invention which may be realized depending on the requirements of particularly intended applications. All other embodiments that may be apparent to those skilled in the art based on the disclosures herein are within the spirit or scope of the invention as defined in the appended claims.

In order to mitigate the drawbacks of the conventional use of keys to unlock firearms, or locking on external components of firearms, such as a trigger, the subject system and method provide for a keyless gun lock structure based on the principle of electronic locking, where a lock operation is carried out, for instance, by the press button actuation and an unlock operation is carried out for instance with secure password controlled access (or other suitable measures known in the art for simply yet securely controlling unlock access). The subject system and method provide for a gun lock structure which extends into the barrel of firearms to provide a locking mechanism.

In accordance with certain aspects of the present invention, the subject system and method provide an electronic gun lock for a firearm, which provides simple and effective locking of the firearm, and which generally simplifies management and control of that firearm. The system and method thus guard against abuse of the firearm. The system and method preferably employ secure password access, obviating the need for possession of a conventional key for unlocking access, which greatly facilitates the use of the firearm and mitigates various drawbacks caused by reliance upon traditional key access. A user may thereby quickly unlock a firearm, even in dark or dimly lit settings. In addition, the subject system and method mechanically locks the firearms by extending into and sufficiently filling the interior of the barrel to impair and thereby disable the firearm's ability to discharge. This enables a user to safely carry a locked firearm when performing daily patrol tasks, for example, then quickly unlock and remove the lock at any time in the event of an emergency situation requiring use of the firearm. There is no need to disengage and remove complex locking devices such as restraints for any moving parts of the firearm. The unlocking operation is simple and fast.

A number of exemplary embodiments are illustratively disclosed herein for a sample application, namely a pistol, or handgun, of conventional type. Various embodiments suited for different types of firearms in applications other than those illustrated herein may be implemented without departing from the spirit or scope of the invention as defined by the appended claims. Again, by way of example, certain exemplary embodiments are summarized below.

A first embodiment of the present invention provides an electronic gun lock for firearms, generally comprising: an outer casing, a locking device, and a control device. The outer casing preferably includes: a first outer casing and a second outer casing. The locking device preferably includes: a linear motor, push rod (or other such extension rod), one or two connecting rods, and a locking component (or locking member). Preferably, a first end of the push rod is connected with the output shaft of the linear motor. The first end of the connecting rod is connected with the second end of the push rod, the second end of the connecting rod is connected to the side face of the locking component that is passed through by the rotation shaft, and the connecting rod extends at an angle with respect to a horizontal line extending along the push rod and/or barrel of the given firearm.

A rotation shaft is preferably installed on the locking component, and one or both ends of the rotation shaft are mounted on the second outer casing. The second outer casing serves to house the push rod, the locking component and the connecting rod, wherein the second outer casing is configured to be inserted into a barrel of a firearm that needs to be locked. The second outer casing is preferably formed with one or more openings located for instance at positions above and below the locking component. The opening is of a size and shape sufficient to allow a portion of the locking component to pass through the opening when rotated to and from its locked position.

The control device is connected to the linear motor for transmitting control signals to the linear motor to direct the linear motor to work and thereby drive the push rod to undergo a linear reciprocating motion. The first outer casing serves to house the linear motor and the control device, and the first outer casing is fixed to an end of the second outer casing.

A second embodiment of the present invention provides an electronic gun lock for a firearm, generally comprising: an outer casing, a locking device and a control device. The outer casing preferably includes: a first outer casing and a second outer casing. The locking device preferably includes: a linear motor, a push rod, one or two connecting rods, and a locking component. The first end of the push rod is connected with the output shaft of the linear motor. A rotation shaft is preferably installed on the locking component, and one or both ends of the rotation shaft are rotatably coupled to the second outer casing. A fixing device is provided at one or both sides of locking component (the side(s) that is passed through or otherwise engaged by the rotation shaft). The fixing device is configured to limit movement of the locking component on the rotation shaft; furthermore, one or more connecting units may be suitably disposed between the rotation shaft and/or the fixing device and the locking component to facilitate the rotatable coupling.

A first end of the connecting rod is connected with the second end of the push rod, and a second end of the connecting rod is connected with the fixing device. The connecting rod extends therebetween at an angle with respect to the horizontal line. The second outer casing serves to house the push rod, the locking component, the fixing device and the connecting rod, wherein the second outer casing is configured for coaxial insert into a barrel of the firearm that needs to be locked. The second outer casing is preferably formed with one or more openings above or below the locking component, and the opening is suitably sized and shaped to allow a portion of the locking component to pass through of the opening during rotation to and from its locked position.

The control device is connected to the linear motor for transmitting control signals to the linear motor to direct the linear motor to work and thereby drive the push rod to undergo a linear reciprocating motion within the second outer casing. The first outer casing serves to house the linear motor and the control device, and the first outer casing is fixed to an end of the second outer casing.

A third embodiment of the present invention provides an electronic gun lock for firearms, generally comprising: an outer casing, a locking device and a control device. The outer casing preferably includes: a first outer casing and a second outer casing. The locking device preferably includes: a linear motor, a push rod, one or two connecting rods, and a locking component. Preferably, the first end of the push rod is connected with the output shaft of the linear motor. A rotation shaft is preferably installed on the locking component in pivotally displaceable engagement therewith. In this embodiment, one or both ends of the rotation shaft are non-rotatably coupled to the second casing, such that the locking component is rotatable about an axis defined by the rotation shaft, with the rotation shaft preferably passing through the locking component. A protruding device is provided surrounding the rotation shaft and disposed at one side surface of the locking component. The protruding device may be equipped with suitable connecting units for securement to one side of the locking component to reinforce and stabilize the locking component's rotatable coupling about the rotation shaft.

The first end of the connecting rod is connected with the second end of the push rod, and the second end of the connecting rod is connected to the protruding portion or the connecting units. The connecting rod preferably extends between the push rod and the protruding portion/connecting units at an angle with respect to the horizontal line.

The second outer casing preferably serves to house the push rod, the locking component, the protruding device, and the connecting rod, wherein the second outer casing is configured for coaxial insert into a barrel of the firearm needing to be locked. The second outer casing is formed with one or more openings located above or below the locking component, each opening being sized and shaped sufficiently to allow a portion of the locking component to pass through of the opening during rotation to and from its locked position.

The control device is connected to the linear motor for transmitting control signals to the linear motor to direct the linear motor to work and thereby drive the push rod to perform a linear reciprocating motion through the second outer casing (and barrel of the firearm). The first outer casing serves to house the linear motor and the control device, and the first outer casing is fixed to an end of the second outer casing.

In certain embodiments not shown, the locking component may be supported by the second outer casing but not actually contained within that outer casing. For example, the locking component may be suspended from a terminal end of the second outer casing. The locking component would not actually enveloped within the confining walls of the second outer casing, then, although it may be angularly displaced between its locked and unlocked positions, much as in the other disclosed embodiments, by operation of the extension/push rod, connecting rod, and any suitable connection units employed. No access opening would need to be cut through the second outer casing for the locking component to pass through in such embodiments, since the locking component remains clear of that second outer casing's surrounding walls.

In each of these first, second, and third embodiments, the relationship between the length of the second outer casing and the total straight length of the push rod, the connecting rod and the locking component as connected together in an unlocked state is preferably such that when the second outer casing is inserted a specified depth into the barrel of the firearm to be locked, all or a portion of the locking component is positioned within the firearm's the chamber. Preferably, when the second outer casing is sufficiently inserted in this manner into the barrel of the firearm that needs to lock, the first outer casing is disposed in contact with the end of the barrel. Thus, all or a portion of the locking component reaches the chamber of the firearm to obstruct normal loading of a projectile, hence preclude discharge of the same. Alternatively, the second outer casing is configured such that when coaxially inserted fully into the barrel of the firearm and stopped by the end of chamber, all or a part of the locking component is located within the chamber sufficiently to obstruct loading of a bullet, shot, or other such projectile therein.

In each of these first, second, and third embodiments, the locking component is preferably sized or otherwise configured such that when the locking component is disposed partially or wholly within the chamber for locking the firearm, a portion of the locking component may pass through an opening of the second outer casing by rotation. The locking component may then catch, latch against, or otherwise retentively engage a surrounding surface or structure of the chamber, such as where it meets or transitions from the barrel, so that the gun lock cannot be withdrawn from the barrel.

In each of these first, second, and third embodiments, the locking component is preferably configured as a form of cuboid in which the cross section normal to the longest side is sufficiently small that when the longest side of the locking component is aligned with the long axis of the second outer casing, the locking component may be contained within the second outer casing. In addition, the length of the longest side of the cuboid and the cross sectional width are such that at least the following conditions are preferably satisfied:

- The locking component is able to rotate within the second outer casing to emerge through the opening formed in that second outer casing above or below.
- The locking component's cross sectional dimension perpendicular to its longest side is such that there is enough clearance for the locking component to pass through the opening when rotated into or out of its locked position.
- When in its locked position, the locking component protrudes out through the opening to make retentive contact with a surrounding inner surface or structure of the chamber of the given firearm.
- To facilitate ease of movement of the locking component into and out of engagement with a surrounding inner surface or structure of the firearm, the locking component is preferably formed with a tapered corner peripheral profile at one or more of its leading edges (leading when the locking component rotates to its locked position). More specifically, at such tapered corner, the transition between a longitudinally extending (or long) edge surface of the locking component and a laterally extending (or short) edge surface of the locking component preferably forms a curvilinear arced transition surface, which maintains clearance from and does not contact the inner surface of the chamber.
- Where the second outer casing is formed with a single opening either above or below the locking component, at least the one corner of the locking component nearest to the opening is so formed, preferably, with such tapered corner peripheral profile. In the illustrated embodiment, that would be at least one corner either at the top or bottom of the locking component when it is in the locked position.
- Where the second outer casing is formed with an opening both above and below the locking component, at least two diagonally offset corners of the locking component are each preferably formed with such tapered corner peripheral profile. In the illustrated embodiment, that would be at least one corner at each of the top and bottom of the locking component when it is in the locked position.

In each of these first, second, and third embodiments, the locking component may be configured alternatively as a form of ellipsoid, where its edge surfaces extending between planar lateral side surfaces. According to the number of openings formed in the second outer casing, the edge surfaces of the locking component form one or two end faces at longitudinally opposed ends (along the long or major axis) of the ellipsoid. The diameter of the minor axis of the ellipsoid (along its short axis) is configured to be smaller than the inner diameter of the second outer casing; and, the diameter of the minor axis of the ellipsoid is smaller than the width of the second outer casing opening through which the locking component protrudes when in its locked position. The length of the ellipsoid (or diameter of its major axis) is preferably set to allow the locking component to rotate freely within the second outer casing. The ellipsoid is thus configured to pass through the opening of the second outer casing upon sufficient rotation to form close retentive contact with an inner surface of the firearm's chamber, and thereby establish a locked position. Such close contact maintained by the locking component when in its closed position may form a point contact, a line contact, or a face contact with the surrounding inner surface of the given firearm.

The surfaces of the locking component that contact the inner surface of the firearm's chamber upon rotation are in suitable conformity with the inner surface of the chamber of firearms to be locked. Preferably, the contacting surface of the locking component (which conforms to an opposing inner surface of the firearm's chamber for locking) is formed to define a rough non-slip surface.

In each of these first, second, and third embodiments, the connecting ends of the connecting rods are connected in a rotatable manner for pivotal displacement relative to the push rod, locking component, or parts/extensions thereof. Preferably, the other end of the second outer casing away from the locking component includes a port that is configured to be blocked by a flexible member, preferably formed of a nylon, plastic, or other such material. Preferably, a side of the locking component is formed with one or more positioning units. A first positioning unit may be configured to limit the movement of the connecting rod, so that in its unlocked state, the long axis of the locking component extends generally parallel to a longitudinal direction of the second outer casing. A second positioning unit may be configured to limit the movement of the connecting rod, so that the connecting rod may only drive the locking component to rotate (clockwise or counterclockwise) by a desired angle to its locked state.

The side surface of the push rod preferably defines a third positioning unit for limiting movement of the connecting rod. The third positioning unit forms a recessed area into the push rod's side surface at or near its second end. A wall(s) of the recessed area is arranged and shaped to support the connecting member during operation, such that the long axis of the locking component extends generally in parallel to the long axis direction of the second outer casing when in its unlocked state, and the locking component is rotated clockwise or counterclockwise by a desired angle to its locked state. Alternatively, an inner surface of the second outer casing may include such positioning unit for stopping the rotation of the locking component such that the long axis of the locking component extend generally parallel to the long axis direction of the second outer casing when in the unlocked state.

In each of these first, second, and third embodiments, the first outer casing preferably provides two or more input buttons operably connected to the control device which issues lock and unlock commands. Preferably, an unlock command is issued in the form of an unlocking password. The electronic gun lock preferably further includes: a built-in power source for supplying power to the control device, preferably a detachable battery, or more specifically a detachable rechargeable battery for certain embodiments and applications. The electronic gun lock preferably further includes: a communication component connected to the control device, suitably configured to perform network communication with background services to implement such features as remote unlocking, prohibiting unlocking, changing password, and performance monitoring. The electronic gun lock preferably further includes: a positioning device for transmitting the geographical position of the electronic gun lock to the background services.

A fourth embodiment of the present invention further provides a method for unlocking an electronic gun lock. In accordance with this embodiment, a user may input the unlock command by pressing two or more buttons of the lock. In a combination sequence of user inputs through the buttons, if there is one sequence of consecutive inputs that matches a predefined unlock command or password, then the control device would issue a control command to the linear motor to operate an unlock operation.

A fifth embodiment of the present invention further provides a method for setting a password for unlocking an electronic gun lock. In accordance with this embodiment, a user may simultaneously press any two of the two or more buttons to enter into a control mode. In the control mode, two or more buttons may be pressed to input a password modification command. Keeping the buttons pressed, a separator command may be input, after which two or more buttons may be pressed to input the original password. Two or more buttons may be pressed thereafter to input a separator command, after which two or more buttons are pressed to enter a new password. Finally, two or more buttons may be further pressed to enter a completion command to denote the end of new password setting operation. Furthermore, for confirming the new password, the user may press two or more buttons to input a separator command, then press two or more buttons to repeat the same new password before finally pressing two or more buttons to enter the completion command.

Turning now to the drawings, unless specifically noted otherwise, the same reference characters refer to identical or comparable parts or portions across the various embodiments described herein. In the various views shown in the FIGS., reference character 1 indicates an interface, reference character 2 indicates an indicator light, reference character 3 indicates an input button, reference character 4 indicates a second outer casing, reference character 5 indicates an opening, reference character 6 indicates a first outer casing, reference character 7 indicates a rotation shaft, reference character 8 indicates a linear motor, reference character 9 indicates a push rod or other such extension rod, reference character 10 indicates a connecting rod, reference character 11 indicates a locking component, reference character 12 indicates a concave surface, reference character 13 indicates a fixing device, and reference character 14 indicates a protruding portion.

FIG. 1 is a schematic external perspective view of an electronic gun lock system formed in accordance with one exemplary embodiment of the present invention. FIG. 1 schematically illustrates the external structure of the electronic gun lock system. The exterior of the system is defined by a casing, which may be divided into two parts: the first outer casing 6 and the second outer casing 4. Alternatively, the casing may also be integrally formed as one unitary structure. Regardless of its structure as implemented for a particular embodiment and application, since the first and second outer casing portions respectively accommodate different components, the casing is divided into a first outer casing 6 and a second outer casing 4, respectively, and referred to as such herein for convenience of description. In addition, as shown in FIG. 1, the first outer casing 6 is preferably provided with user-manipulable buttons 3, an indicator light 2, and an interface 1 for charging the internal battery. When the built-in battery uses a lithium battery, for instance, the interface 1 may employ a USB type interface. The second outer casing 4 is preferably formed with an access opening 5 through which a locking component 11 may extend to protrude transversely from the casing's outer peripheral profile to realize the locking function. The locking component 11 is mounted to the second outer casing by use of a rotation shaft. At least one end of the rotation shaft 7 is coupled to the second outer casing 4.

Figure 2:
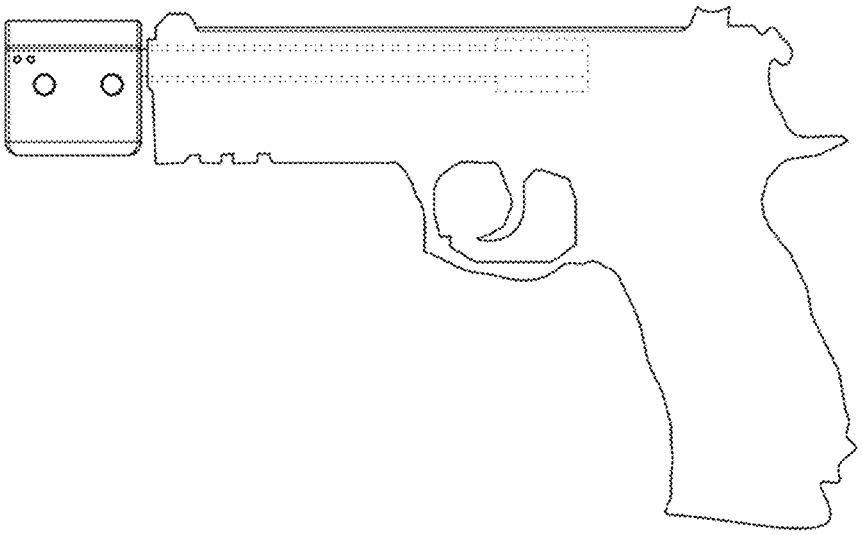
FIG. 2 is a schematic elevational side view of the embodiment of FIG. 1, illustrating use with a pistol firearm in one sample application.

FIG. 2 is a diagram showing an example of the electronic gun lock system with a sample firearm—in this sample case a pistol-type handgun. As shown in FIG. 2, the second outer casing of the electronic gun lock is inserted into the barrel of the firearm to be locked, and the access opening 5 of the second outer casing is preferably located somewhere at the chamber of the firearm. In use, a user may lock the firearm by pressing any one of the buttons of the gun lock, once it is properly installed on the given firearm. The locking component is thereby driven by the control device and a powered device coupled thereto (including an electrically powered linear motor, for example) to rotate from its unlocked position to its locked position. As a result, a portion of the locking component is caused to extend through the one or more opening(s) 5 of the second casing and retentively engage a surrounding inner surface of the firearm at or near the boundary between firearm's barrel and chamber, preferably on the chamber side of the boundary. The electronic gun lock then cannot be pulled out from the barrel, as the surface of the portion(s) of the locking component which passes through the opening(s) of the second outer casing makes and maintains close contact with the inner surface of the chamber of the firearm. The close contact provides sufficient frictional force or stopping/blocking force to prevent withdrawal of the gun lock from its engagement with the barrel of the locked firearm.

In the disclosed embodiments, the first outer casing 6 and the second outer casing 4 may be joined together by any suitable measures known in the art be either removable or non-removable from one another, depending on the requirements of the particularly intended application. Removable fixing measures may include, for example, a screw, a bolt, or other such fastener. Non-removable fixing measures may include, for example, one-piece molding to provide an integrally formed casing structure, welding, or other measures for fusing the first and second outer casing portions together.

In the disclosed embodiments, the manner in which one end or both ends of the rotation shaft is/are mounted on the second outer casing includes: the rotation shaft being either rotatable or non-rotatable. Where one or both ends of the rotation shaft are non-rotatably mounted on the second outer casing, a given end of the rotation shaft may be fixedly mounted, for example, by welding, riveting, or the like. Where one or both ends of the rotation shaft are rotatably mounted on the second outer casing, the second outer casing may be formed with a circular groove or with a protrusion at an inner surface opposing each end of the rotation shaft in question. The protrusion may form a circular cavity, and an inner diameter defined by the circular cavity, or by the circular groove, is configured to be larger than the diameter of the given end of the rotation shaft. The given end of the rotation shaft may be inserted into the circular groove or into the circular cavity of the protrusion for rotatable support therein.

In one example, a circular groove may be formed at an inner surface of the second outer casing opposite each mounted end of the rotation shaft. Alternatively, a protrusion having a circular cavity may be formed, for example, as a hollow cylinder or a polygonal structure having a through hole, etc. The inner diameter of the circular groove or the inner diameter of the circular cavity is configured to be larger than the diameter of the corresponding end of the rotation shaft. The end of the rotation shaft may be inserted for rotatable support into the circular groove or into the circular cavity of a protrusion. In this installation mode, the rotation shaft may rotate within the circular groove or cavity when external force is applied thereto.

Because one or both ends of the rotation shaft can be mounted on the second outer casing in rotatable or non-rotatable manner, the locking component may be disposed to rotate in various ways. It may be disposed to rotate around the rotation shaft, or rotate together with the rotation shaft. When one or both ends of the rotation shaft are mounted on the second outer casing in a non-rotatable manner, the locking component is preferably coupled to the rotation shaft in angularly displaceable manner, such that the locking component may rotate about a fixed rotation shaft. This may be a pivotally coupling where the locking component displaces pivotally about an axis defined by the rotation shaft. Otherwise, in certain alternate embodiments, this may be a non-pivotal coupling which nonetheless enables such angular displacement as a swinging movement of the locking component offset from the axis of the rotation shaft by a swing arm distance. For example, an eccentrically offset coupling or a cammed coupling interconnection between the rotation shaft and locking component may be employed in that regard.

When one or both ends of the rotation shaft are rotatably mounted on the second outer casing, it is feasible to couple the locking component to the rotation shaft in such a manner that the locking component can either rotate about the rotation shaft or rotate together with the rotation shaft. The choice of coupling type will depend on the requirements of the particularly intended application.

In a configuration where only one end of the rotation shaft is mounted on the second outer casing, in order to prevent the locking component from being detached from the other end of the rotation shaft, a fixing device is preferably installed between the unmounted end of rotation shaft and the closest side face of locking component. A suitable fixing device include, for example: a fastening nut which threadedly engages a matingly threaded free end of the rotation shaft, a retention pin which transversely engages the rotation shaft to block release of the locking component from the rotation shaft, or the like. Where the mounted end of the rotation shaft is rotatably mounted on the second outer casing (for example, by inserting that end into a circular groove formed on the inner wall of the second outer casing or into a protruding circular cavity there), the fixing device may also constitute a soldered or welded joint fusing the rotation shaft and the locking component together.

The locking device formed in part by the push rod may employ one or two connecting rods, depending on the requirements of the particularly intended application. A first end of the connecting rod is connected to the second end of the push rod. More specifically in the embodiments shown, the first end of each connecting rod is connected to a recessed side of the push rod's second end. When multiple connecting rods are employed, a first end of one connecting rod is connected at one such recessed side at the second end of the push rod, while a first end of the other connecting rod is connected to another such recessed side at the second end of the push rod. Similarly, a second end of one connecting rod is connected to one side of the locking component, preferably the side that is passed through by the rotation shaft, and a second end of the other connecting rod is likewise connected at that side of the locking component passed through by rotation shaft.

Due to the limited inner diameter of the barrel, in order to save space, in a preferred embodiment, the locking device employs but one connecting rod. In addition, both the connection between the connecting rod and push rod, and the connection between the connecting rod and locking component are preferably rotatable/pivotally displaceable connections. For example, a circular hole may be provided at a preset connection position of the second end of the push rod, and a circular hole may be provided at a preset connection position at the side of the locking component that is passed through the rotation shaft. Furthermore, both ends of the connecting rod may be equipped with a cylindrical protrusion insertable into the corresponding circular holes. For example, a cylinder having suitable length and diameter to be inserted into the circular hole may be employed. Consequently, the shape of the connecting rod is of a widely extended U, "⊔", with cylindrical protrusions at both of its first and second ends engaging the circular holes of push rod and locking component respectively. A rotatably engaged connection linkage is thereby realized.

The manner of connection between the connecting rod and the locking component preferably includes a direct connection or an indirect connection. A direct connection may be formed where the connecting rod is directly in contact with the locking component; and, an indirect connection may be formed by the connecting rod and the locking component being connected by an intermediate object intervening therebetween. For example, a handle may be mounted at one end to a side of the locking component as an intermediate object which also connects the connecting rod at the other end.

The second outer casing may be formed with an opening at a top wall surface and/or at a bottom wall surface that would surround the locking component. Once the rotation shaft is installed on the second outer casing and the locking component is coupled thereto, the locking component relative is fixed in location relative to the second outer casing, depending on the requirements of the particularly intended application. The opening may be disposed above or below the locking component, or in certain embodiments disposed at multiple locations, one above and one below the locking component.

The size (and shape) of the opening(s) at the top wall surface and/or at the bottom wall surface of the second outer casing needs to be large enough so that a portion of the locking component may protrude through the opening during rotation. That is, the width of the opening is greater than the width of the locking component's protruding portion, and the length of the opening is greater than the length of the locking component's protruding portion to ensure that such protruding portion of the locking component may pass through the opening unhindered during rotation.

Figure 3:
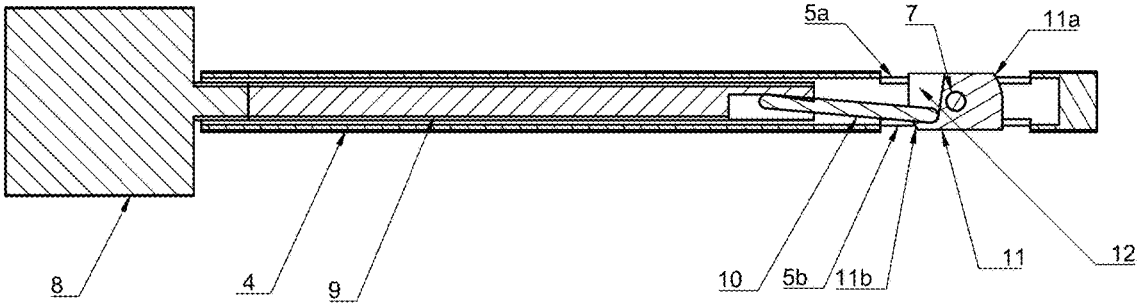
FIG. 3 is a schematic sectional side view of certain portions of the embodiment of FIG. 1, shown with a certain outer portion of a casing removed for clarity of illustration, with the system disposed in an unlocked state.

FIG. 3 is a schematic sectional illustration of certain electronic gun lock portions when in an unlocked state in accordance with the first embodiment of the present invention. As shown in FIG. 3, the second outer casing has openings formed both above and below the locking component. The second outer casing contains the push rod, the locking component, and the connecting rod. In the unlocked state, the locking component is as angled to a laterally directed orientation (angular position) to be withdrawn inside the outer peripheral profile of the second outer casing. That is, the locking component is located in the second outer casing rotated to be angled such that its longest side substantially aligns in direction with the long axis of the second outer casing.

Figure 4:
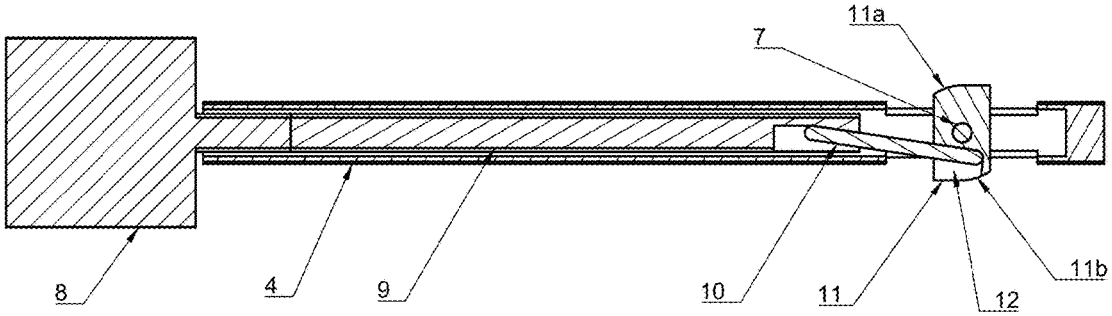
FIG. 4 is a schematic sectional side view of certain portions of the embodiment of FIG. 1, as shown in FIG. 3, except with the system disposed in a locked state.

FIG. 4 is a schematic sectional view of certain electronic gun lock portions when in a locked state in accordance with the first embodiment of the present invention. As shown in FIG. 4, during the locking process, the linear motor operates to drive the push rod to move linearly forward, and the push rod pushes thereby the locking component to rotate counterclockwise. During this process, a portion of the locking component is caused to pass through a corresponding opening of the second outer casing to protrude transversely beyond the outer peripheral profile thereof. To reach this locked state, the locking component is rotated by about 90 degrees counterclockwise in the illustrated embodiment, to become reach an erect angular position. The protruding part(s) of the locking component retentively engages the surrounding inner surface or structure of the barrel/chamber, whereby the given firearm is locked.

The locking component 11 is preferably formed with a tapered corner peripheral profile at one or more of its leading edges (leading when the locking component 11 rotates into its locked position). More specifically, at each such tapered corner a transition surface 11*a*, 11*b* is formed between a longitudinally extending longer edge surface of the locking component and a laterally extending shorter edge surface of the locking component. Each tapered corner 11*a*, 11*b* is preferably provided at a leading edge of the locking component which leads as the locking component rotates from the unlocked to locked positions. In the sample embodiment shown, this locking rotation is rearward, or up from the second outer casing 4 back towards the first outer casing side of the system as shown (or counterclockwise in the particular view of FIGS. 3-4). Each tapered corner is formed by a curvilinear arced transition surface, which is configured to maintain sufficient clearance from the inner surface of the chamber to avoid contact therewith during use. This facilitates ease of locking and releasing movement of the locking component into and out of locking engagement with a surrounding inner surface or structure of the firearm.

In the embodiment shown, openings 5*a*, 5*b* are formed in the second outer casing both above and below the locking component 11. Accordingly, tapered corners 11*a*, 11*b* are formed on the locking component 11 at diagonally offset top and bottom corners thereof.

The manner in which the electronic gun lock is used to lock a firearm is now described in detail. Based on the structure of barrel and chamber of a firearm, the manner in which the electronic gun lock carries out the locking operation includes the following. Where the inner diameter of a firearm's barrel is smaller than the inner diameter of its chamber, a first locking mechanism includes: inserting the second outer casing into the barrel from its front open end, and inserted deep enough so that all or a portion of the locking component is located at the chamber. The locking component is then caused to rotate clockwise or counterclockwise such that a portion of the locking component can pass through of the opening in the second outer housing and engage the chamber side of the boundary between the barrel and chamber. Since the inner diameter of the barrel is smaller than the inner diameter of the chamber, the electronic gun lock which now engages the chamber's inner surface/structure cannot be pulled out of the barrel, thereby locking the gun.

The minimum angle by which the locking component rotates clockwise or counterclockwise preferably satisfies the following conditions. The locking component is rotated enough that its protruding portion reaches and engages the inner surface/structure within the chamber, so that the gun lock cannot be pulled out of the barrel. In the disclosed embodiment, the locking component rotates clockwise or counterclockwise through an angle of approximately 90 degrees between its unlocked and locked positions. After the electronic gun lock completes locking of the firearm, to unlock the firearm, a control signal is sent to the linear motor to cause the locking component to perform a reverse rotation. The locking component is thereby returned to its unlocked position, thereby unlocking the gun lock for removal from the firearm's barrel.

In order to prevent the locking component from rotating clockwise or counterclockwise at an angle exceeding 90 degrees, a positioning unit is preferably formed into the side of the locking component at which the connecting rod is coupled. The positioning unit limits the movement of the connecting rod during rotation. Therefore, when locking a firearm, the locking component rotates clockwise or counterclockwise but is stopped at an angle of about 90 degrees by positioning unit.

It may also useful to provide another positioning unit on the side of the locking component at which the connecting rod is coupled, to limit the movement of the connecting rod at its other position. In that position, the long axis of the locking component is stopped at an angle parallel to the long axis direction of the second outer casing in the unlocked state.

The positioning unit may be any suitable type of device or structure capable of blocking the movement of the connecting rod, such as a protruding unit similar to a column. In addition to providing such positioning unit, a suitable linear motor may also be selected such that the maximum linear travel distance of the linear motor regulates the locking component's rotation, restricting it to a desired angle range, such as defined by the 90-degree angle limit shown, clockwise or counterclockwise.

A second mechanism for locking includes: inserting the second outer casing into the interior of the barrel, where the locking component in its locked position makes close frictional contact with the inner surface of the barrel or the inner surface of the chamber. A sufficiently strong frictional force is generated that the electronic gun lock cannot be withdrawn from the barrel. Since the inner surface of the barrel is typically formed with a twist line, if the surface of the locking component is closely contacted with the inner surface of the barrel to lock the firearm, damage to the twisted wire may occur. This would undesirably affect the firing performance of the firearm. Hence, it is preferable for the locking component to make close contact with the inner surface of the chamber to prevent withdrawal of the electronic gun lock from the barrel. After the electronic gun lock completes the locking of the firearm, to unlock the firearm, a control signal may be sent to the linear motor to cause the locking component to perform a reverse rotation and return to its unlocked position, freeing the gun lock for removal from the barrel.

Also with the second mechanism for locking, a suitable linear motor may be selected such that the maximum linear travel distance of the linear motor enables the locking component to rotate 90 degrees clockwise or counterclockwise precisely. A positioning unit may be provided at the side of the locking component to which the connecting rod is coupled, restricting the locking component to only rotate by 90 degrees clockwise or counterclockwise to its locked position. In addition, another positioning unit may be disposed at that side of the locking component, such that the long axis of the locking component is stopped at an angle parallel to the long axis direction of the second outer casing in the unlocked state.

In the above, two ways of locking the firearm are described, in which the positioning unit is provided at the side of the locking component to which the locking component is coupled to the connecting rod, and they can ensure that the locking component can only rotate 90 degrees clockwise or counterclockwise. However, in practice, by suitably arranging the position of the positioning unit otherwise, the locking component may be caused to rotate clockwise or counterclockwise by any desired angle, which can be 90 degrees or other angles, such as 80 degrees, 85 degrees, and so on.

In addition, a positioning unit may also be disposed at a side of the push rod at which the connecting rod is connected. The positioning unit limits the long axis of the locking component to remain substantially parallel to the long axis direction of the second outer casing in an unlocked state. Also, it may block the connecting rod from continuing to move beyond a certain point, whereby the locking component can be set to rotate clockwise or counterclockwise by any suitable angular range, such as 80 degrees, 85 degrees, 90 degrees, and so on.

In the first embodiment, the relationship between the total length of the push rod, the connecting rod and the locking component that are connected together in the unlocked state and the length of the second outer casing is: when the second outer casing is inserted into a specified depth inside the barrel of the firearm to be locked, all or a portion of the locking component is located at the position of the chamber. Since the barrel lengths of different types of firearms are different, one type of electronic gun lock is generally applied to comparable types of firearms. Thus, the second outer casing may be marked with a length scale mark. Preferably, a stop mark is applied on the second outer casing that protrudes into the barrel. In this way, the second outer casing may be inserted into the appropriate inner depth of the barrel of the firearm to be locked—to where all or part of the locking component is located at the chamber. For the same type of firearm (in terms of barrel length), when the electronic gun lock is manufactured, the relationship between the total length of the push rod, the connecting rod, and the locking component that are connected together in the unlocked state and the length of the second outer casing is preserved. The second outer casing may be guided to a specified depth into the barrel of the firearm to be locked by the visible tick mark on the second outer casing protruding out of the barrel.

For the purpose of making the manufacturing process simple and convenient, the relationship between the total linear length of the push rod, the connecting rod and the locking component as connected together in the unlocked state and the length of the second outer casing should satisfy the following conditions: when the second outer casing is inserted into the barrel of the firearm to be locked, and the first outer casing is in contact with the front of barrel, all or a portion of the locking component is located at the position of the chamber; alternatively, when the second outer casing is inserted into the barrel of the firearm to be locked and the end of the second outer casing reaches the bottom of the chamber, all or part of the locking component is located at the position of the chamber.

Due to the limitation of the inner diameter of the barrel, in order to save space, in a preferred embodiment, the surfaces of the push rod and the locking component covered by the connecting rod in a stationary state and a moving state are concave, so that the outer side of the connecting rod is recessed compared to the same side of the push rod and the locking component. Alternatively, the outer side of the connecting rode is flush with the same side of the push rod and the locking component. In addition, the two sides of the concave surface may be used as a positioning unit. In particular, the two sides of the concave surface of the locking component may be used as positioning units. In a preferred application, the sides of the concave surface of the locking component are disposed substantially perpendicular to each other. Briefly, a part of the side surface of the push rod connected to the connecting rod is concave, and a part of the side surface of the locking component connected to the connecting rod is concave, so as to reduce the combined volume of the connecting rode together with push rode and locking component.

When the connecting rod is located at the concave surface, both sides of the concave surface can be used as positioning units. For example, in the unlocked state, the concave side of the of the locking component on which the connecting rod rests is positioned such that the long axis of the locking component is parallel to the long axis direction of the second outer casing. That is, the locking component is placed horizontally. By configuring the angle of the concave surface on the side of the locking component to be A°, in the locked state, the locking component is rotated A°. As a result, the connecting rod rests on the other concave side of the locking component, so that it is blocked and stopped at the desired position and angle. In a preferred embodiment, the two sides of the concave surface of the locking component are perpendicular to each other, and when the locking component is rotated by 90 degrees, the connecting rod is blocked by the other concave side of the side locking component. The locking component is thereby stopped when rotated 90 degrees.

Figure 5:
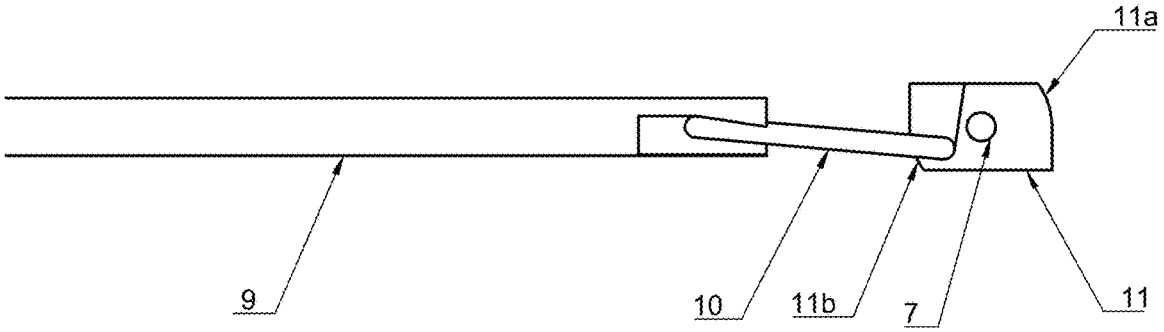
FIG. 5 is a schematic elevational side view of certain isolated portions of the embodiment of FIG. 1, partially cut away, with the system disposed in an unlocked state.
Figure 6:
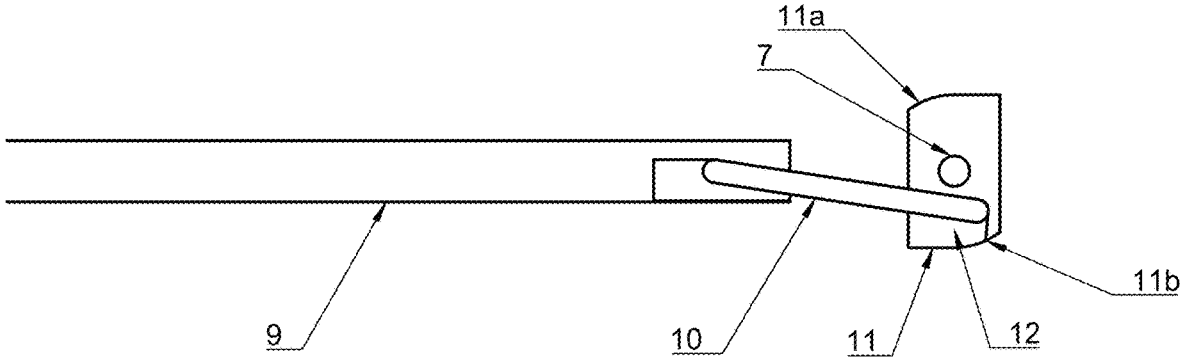
FIG. 6 is a schematic elevational side view of certain isolated portions of the embodiment of FIG. 1, partially cut away, with the system disposed in a locked state.

FIG. 5 is a schematic view showing certain portions of the electronic gun lock in an unlocked state according to the first embodiment of the present invention. FIG. 6 is a similar schematic view with the electronic gun lock in a locked state according to the first embodiment of the present invention. As shown in FIG. 5 and FIG. 6, surfaces of the push rod and the locking component covered by the connecting rod in a stationary (locked) state and a moving (unlocked) state both are concave surface portions, each defining two side surfaces serving as positioning units.

The electronic gun lock system in the disclosed embodiments uses a linear motor in its powered driver. The linear motor functions to directly convert electrical energy into mechanical energy of linear motion. The first end of the push rod is connected to the output shaft of the linear motor. When the control device connected to the linear motor transmits an electrical control signal to the linear motor, the linear motor operates to drive the push rod to undergo linear reciprocating motion. Depending on the type of control signal, the linear motor drives the push rod to perform linear forward motion or linear backward motion.

The linear reciprocating motion of the push rod in turn drives the connecting rod coupled thereto to linearly reciprocate. The connection between the first connecting point of the connecting rod and push rod and the second connecting point of the connecting rod and the side of the locking component is sloped along a diagonal line. The connecting rod therefore extends at an inclined angle relative to a horizontal reference line defined along the push rod and/or the firearm's barrel. This angular offset causes an angular thrust component to be imparted to the locking component when the connecting rod is moved straight forward. The angular thrust pushes the locking component to rotate counterclockwise. When the connecting rod moves linearly backward, it gives the locking component a pulling force, which pulls the locking component to rotate clockwise. In summary, locking and unlocking the gun lock are implemented by counterclockwise rotation or clockwise rotation of the locking component. Furthermore, conventional linear motors known in the art are typically equipped with a push rod already; therefore, a linear motor with push rod may be suitably employed as a combined structure. In order to better control the linear stroke of the linear motor, a linear stepping motor may be used, preferably a linear stepping motor with a push rod already equipped.

In the electronic gun lock as the disclosed embodiments, there is no limitation on the shape of the locking component, as long as the portion(s) of the locking component that passes through the opening(s) in the second outer casing may sufficiently engage the chamber side of the barrel and chamber boundary, so that the gun lock cannot be pulled out from the barrel of the firearm when locked.

There are various ways in which the locking component makes retentive engagement inside the firearm. One approach makes use of both the structural feature of barrel (i.e., the inner diameter of barrel is smaller than the inner diameter of chamber) and the friction created between the surface of the locking component and an inner surface of the chamber to prevent pulling withdrawal of the gun lock from the barrel. In another approach where friction is insufficient to withstand an external pulling force, the way in which the locking component catches on the chamber side of the barrel/chamber boundary serves to prevent removal from the barrel of locked firearm. Even if the locking cannot be achieved by friction, since the inner diameter of the barrel is smaller than the inner diameter of the chamber, the portion of the locking component that passes through the opening in the second outer casing can still retentively engage the boundary of the barrel and the chamber (on the chamber side) to ensure firearm locking. When it is desired to first utilize the friction between the surface of the locking component and the inner surface of the chamber to achieve the purpose of locking, the locking component may be shaped accordingly. The following two examples illustrate use of different shapes for the locking component in this regard.

Example 1

Figure 7:
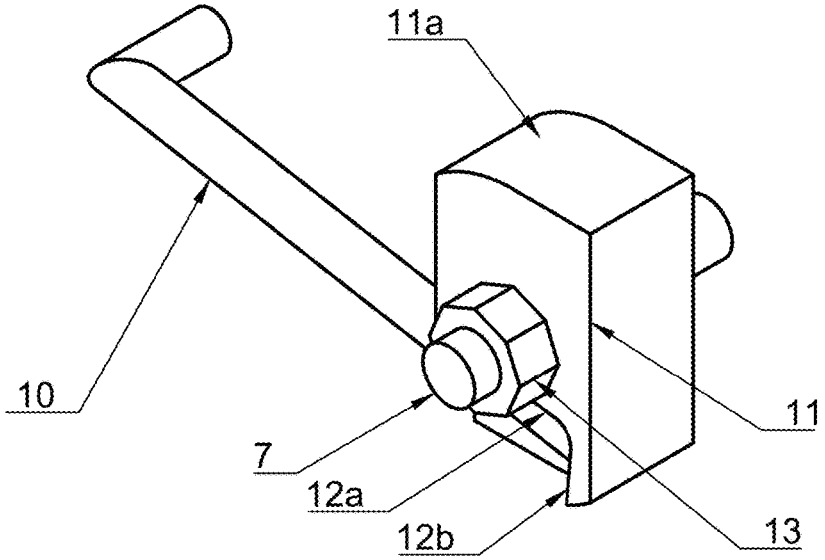
FIG. 7 is a perspective view of certain isolated structural portions of a system formed in accordance with another exemplary embodiment of the present invention, with the system disposed in a locked state.

The locking component is formed in one example with a generally cuboid shape. More specifically, the locking component is preferably shaped in this example with a suitably deformed cuboid body generally similar to a rectangular parallelepiped. The deformation may include, for example, altering one or several straight edge surfaces of the rectangular parallelepiped form to a transitional curvilinear arc, or altering one or several planes of the rectangular parallelepiped to a circular arc surfaces, etc. FIG. 7 is a schematic perspective view illustrating a sample structure of such rectangular parallelepiped-like locking component 11. FIG. 7 shows the rotation shaft 7, the connecting rod 10, the locking component 11, and the positioning units 12*a*, 12*b*.

The lateral/cross dimension of the locking component 11 perpendicular to the longest side in this example is sufficiently small that the locking component 11 may fit inside of the second outer casing when the direction of its longest side is aligned with the long axis of the second outer casing. In addition, the locking component is preferably formed of length along its longest side and width along its cross dimension of satisfy the following. The locking component 11 is rotatably disposed within the second outer casing, such that when the locking component 11 reaches a certain angular position relative to the second outer casing 4, an end face at its longest side emerges out of an access opening 5*a*, 5*b* to closely contact an immediately surrounding inner surface of the chamber of the firearm to lock thereagainst. In that way, the locking component 11 may be 'loaded' into the second outer casing 4 in a longitudinal direction (i.e., the longest side of the locking component 11 substantially aligned with the longitudinal axis of the second outer casing 4). The width of the locking component 11 (i.e., the cross dimension perpendicular to the longest side) is smaller than the width of the opening of the second outer casing 4, such that a portion of the locking component 11 passes through the second outer casing opening 5*a*, 5*b* upon locking component rotation. Locking of the firearm is achieved by frictional force when the end face of the locking component 11 engages the inner surface of the firearm chamber.

Among the four edge surfaces of the locking component 11, the two edge surfaces which protrude through the openings 5*a*, 5*b* of the second outer casing 4 define end faces which may engage immediately surrounding inner surfaces, for instance, of the firearm's chamber. In the embodiment shown, the engaging end faces are formed by the short edge surfaces of the locking component 11. The remaining long edge surfaces may be of any desirable configuration, such as either straight edges or transitional arcs, as they do not make retentive contact with an inner surface of the given firearm during locking use.

As noted, each engaging end face preferably defines a tapered corner in the form of a curvilinear arced transition surface that maintain sufficient clearance from the inner surface of the firearm's inner surfaces during use to facilitate ease of unlocking movement of the locking component 11. The remainder of each engaging end face is formed with a straight or other surface profile suited for optimum retentive engagement (frictional, hooking, or other stopping/latching contact) with the surrounding inner surfaces or structure of the given firearm. In this regard, use of a straight surface profile for the engaging part of an end face may, depending on the particularly intended embodiment and application, serve to increase the contact surface area of the end face for optimal frictional contact with the inner surface of the given firearm's chamber.

Example 2

Figure 8:
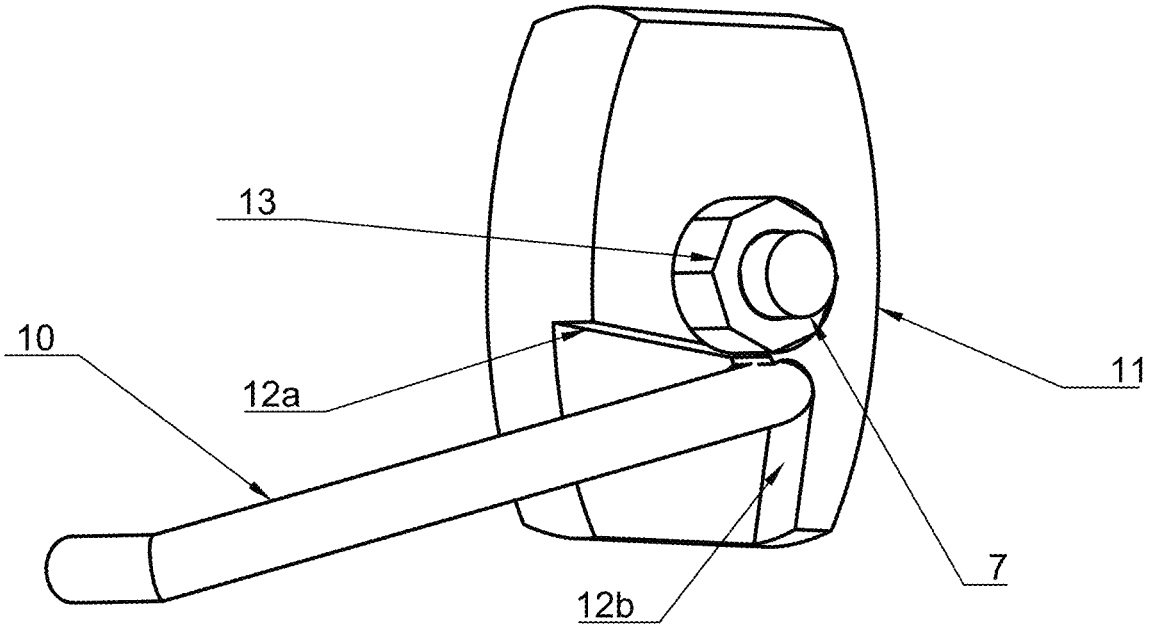
FIG. 8 is a perspective view certain isolated structural portions of a system formed in accordance with yet another exemplary embodiment of the present invention, with the system disposed in a locked state.

The locking component is formed in another example with a generally ellipsoid shape. More specifically, the locking component is preferably shaped in this example with a partially ellipsoid body. In the example shown, at least one of the edge surfaces at the long axis ends of the ellipsoid form an end face for engaging an inner surface or structure of the given firearm when the locking component 11 is in its locked position. FIG. 8 is a schematic perspective view which shows the rotation shaft 7, the connecting rod 10, the locking component 11, the concave surface 12, and the positioning units 12*a*, 12*b* in this embodiment.

In this example, the locking component 11 is configured for use within a second outer casing 4 having openings 5*a*, 5*b* both above and below. Accordingly, the locking component is formed with two end faces at longitudinally opposed ends along the major axis of the ellipsoid, whose minor axis is configured to be smaller in diameter than the inner diameter of the second outer casing 4.

In certain alternate embodiments, the cuboid and partially ellipsoid structures illustrated in FIGS. 7 and 8 may be suitably combined in the locking component 11, depending on the particularly intended application. Additionally, the engaging end face of the locking component 11 may make point contact, line contact, or face contact with a surrounding inner surface or structure of the given firearm. In certain other embodiments, a plurality of bumps may be disposed on one or more end faces defined on the locking component 11 to effect a plurality of point contacts with the surrounding inner surface or structure. Alternatively, a plurality of convex ridge lines may be disposed on one or more end faces defined by the locking component 11 to effect a plurality of line contacts with the surrounding inner surface or structure.

In the illustrated embodiment, face contact with the surrounding inner surface or structure is preferably optimized by configuring the end face to closely conform to the surrounding inner surface of the given firearm's chamber or other suitable inner surface or structure thereof. The engaging end face may be formed with any suitable rough non-slip surface feature known in the art.

The locking component 11 is suitably shaped and sized such that it rotates freely in the direction of motion as driven by the linear motor in the process of locking. For proper execution of the locking process, sufficient clearance must be maintained for the engaging edge surface(s) of locking component 11 from surrounding surfaces and structures for the locking component 11 to rotate without undue obstruction toward the inner surface of the chamber against which it is to be engaged.

In addition, the rotation shaft may pass through the center of the locking component, or the rotation shaft may pass through an eccentrically offset or other suitable position on the locking component according to the requirements of the particularly intended application. For example, depending on whether the second outer casing 4 provides two access openings 5*a*, 5*b* or just one, the rotational axis of the locking component 11 may be set accordingly. The set position of the rotational axis may or may not necessarily be at the center of the locking component.

Figure 9:
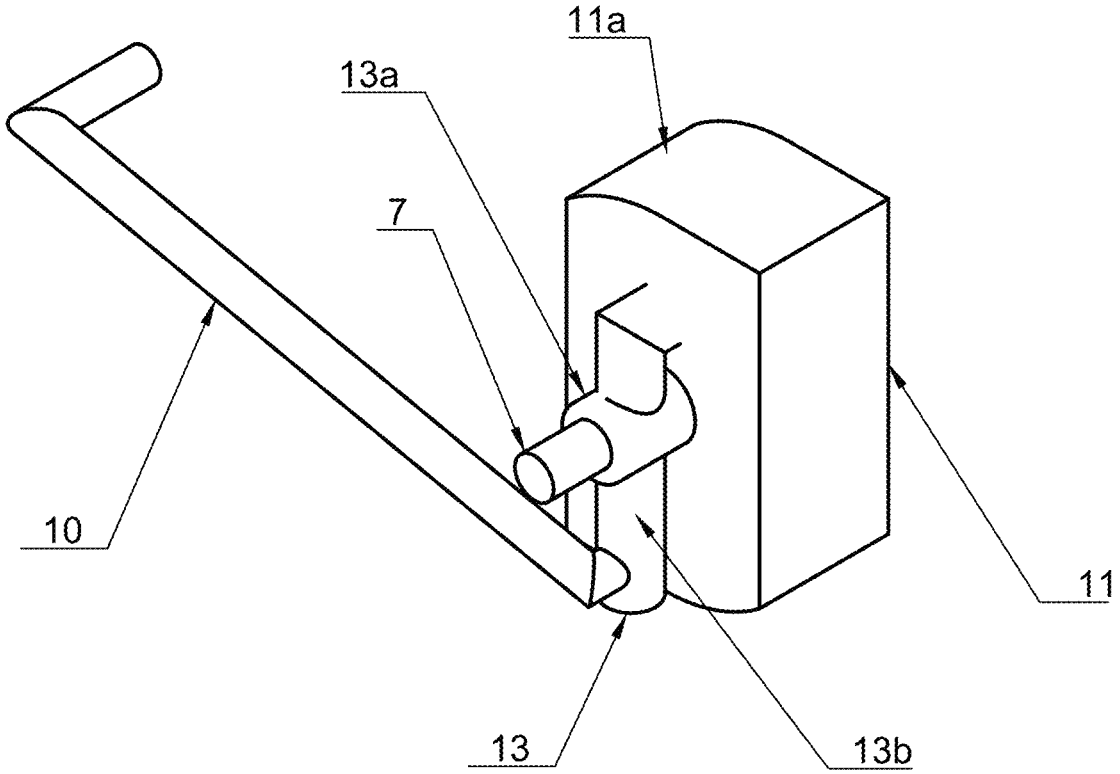
FIG. 9 is a perspective view of certain isolated structural portions of a system formed in accordance with still another exemplary embodiment of the present invention, with the system disposed in a locked state.
Figure 10:
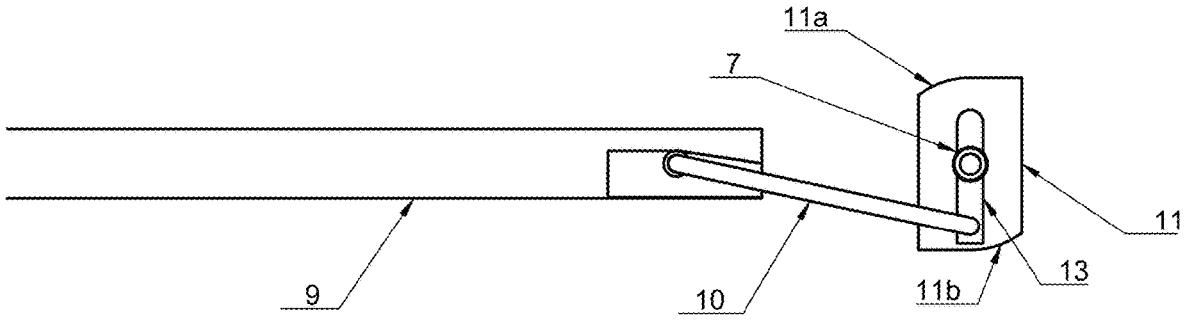
FIG. 10 is a schematic elevational side view of certain isolated portions of the embodiment of FIG. 9, partially cut away, with the system disposed in a locked state.

The interconnection of the connecting rod 10 and locking component 11 may be variously configured to suit the requirements of the particularly intended embodiment and application. In a second embodiment of the present invention such as illustrated in FIGS. 9-10, for example, the locking component is pivotally mounted by a rotation shaft one end or both sides to the second outer casing. A fixing device 13 is disposed between the rotation shaft and a side of the locking component that extends tangentially from the rotation shaft for securing the locking component against movement on the rotation shaft. In addition, one or more connecting devices 13*a*, 13*b* are provided between the rotation shaft and/or the fixing device 13 and the locking component for reinforcing and stabilizing the resulting structure. The locking component 11 moves with the rotation shaft 7 to rotate therewith relative to the second outer casing 4.

The fixing device 13 may include a nut or a pin, or may be a fused connection for fixing the rotation shaft and the locking component together. For the rotation shaft, connecting devices of an ∟ type structure may be employed, or a connection such as a welded joint may be used to directly connect the rotation shaft to the locking component. For the fixing device, a connecting member of an ∟ type structure can be employed.

To facilitate connection between the fixing device and the locking component, the fixing device 13 may be formed in certain embodiments by a pin or a disc that protrudes perpendicularly from the rotation shaft to block release of the locking component from the rotation shaft. Especially in the case where the rotation shaft has only one end mounted on the second outer casing, in order to prevent the locking component from being detached from the other end of the rotation shaft, a fixing device is preferably provided at or near the free end of rotation shaft.

FIG. 9 shows the connecting rod 10, the rotation shaft 7, the locking component 11, and the fixing device 13. Since the second end of the connecting rod 10 is connected in this embodiment to the fixing device 13 instead of directly to the side of the locking component, the need for such features as a recessed, concave surface portion at the near side surface of the locking component to accommodate the direct interconnection is obviated.

Other general aspects of the locking mechanism of the firearm described in connection with the first embodiment are applicable to the second embodiment as well. For example, the manner in which the first outer casing and the second outer casing are fixed together, the connection manner between the connecting rod and the push rod, the connection manner between the connecting rod and a fixing device, the number of access openings in the second outer casing, the size of opening(s), the configuration of the locking mechanism, the relationship between the total of length of push rod, connection rod and locking component and the length of the second outer casing in the unlocked state, the structure and mechanism relating to rotational disposition of the locking component, the provision of positioning units at the side of push rode and locking component, the position of the rotation shaft on the locking component, use of a linear motor and the like, are applicable in this second embodiment among others.

Figure 11:
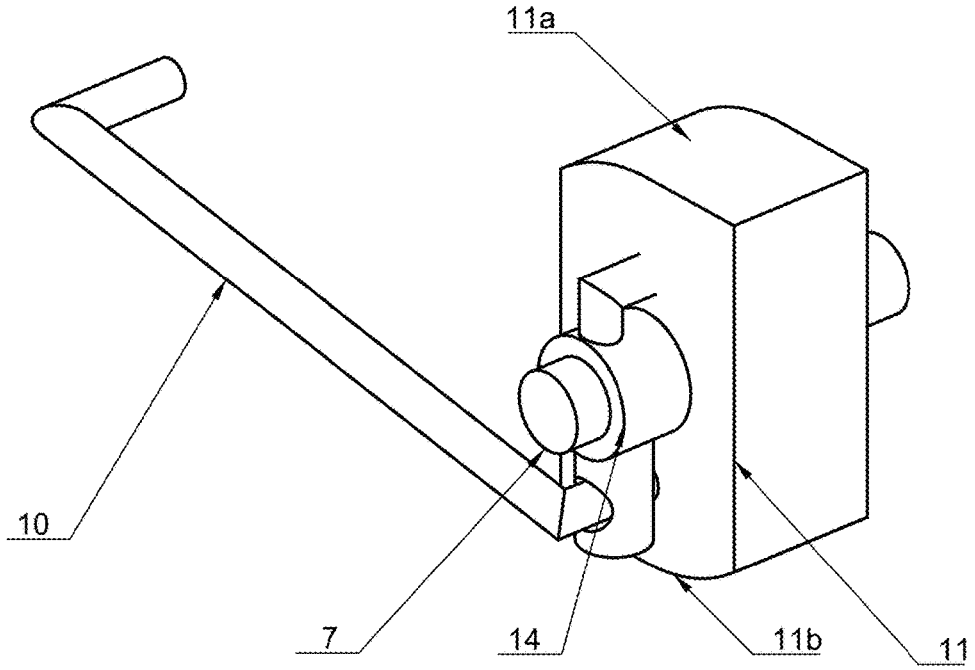
FIG. 11 is one perspective view of certain isolated structural portions of a system formed in accordance with still another exemplary embodiment of the present invention, with the system disposed in a locked state.
Figure 12:
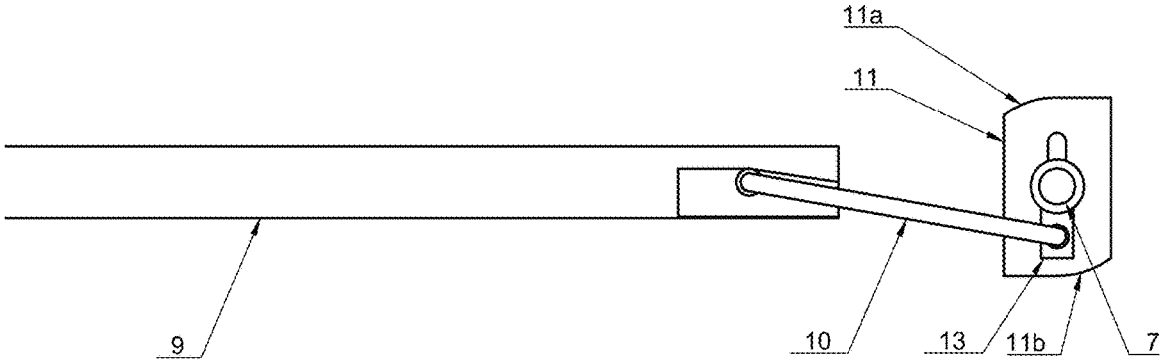
FIG. 12 is a schematic elevational side view of certain isolated portions of the embodiment of FIG. 11, partially cut away, with the system disposed in a locked state.

In a variation of the second embodiment, a third embodiment of the present invention provides for the locking component 11 to be rotatable about the rotation shaft 7. This variation is illustrated in FIGS. 11-12. At the side of the locking component 11 that is pivotally coupled to the rotation shaft 7, a protruding portion 13*a* is provided, surrounding the rotation shaft 7. A connecting device 13*b* connected to a side of the locking component 11 to project suitably therefrom for linkage by the connecting rod 10. The connecting device 13*b* is intermediately supported by reinforcing/stabilizing coupling there with the protruding portion 13*a*.

Where one or both ends of the rotation shaft 7 are non-rotatably mounted on the second outer casing 4, the locking component 11 is rotatably coupled to the rotation shaft 7. The protruding portion 14 then rotatably surrounds the rotation shaft 7. A fixing device 13 projects from the protruding portion 14 much as a rotating lever arm driven by the connecting rod 10 linkage pivotally coupled at or near its free end. Thus, in this third embodiment, the locking component 11 rotates about a rotation shaft 7 that remains stationary relative to the second outer casing 4. Preferably, the connection position of the second end of the connecting rod 10 relative to the locking component 11 is adjustable to adaptively configure the resulting structure as needed.

As compared to the first and second embodiments, the connecting rod 10 in this embodiment is coupled by at its second end by a different connection mechanism with the locking component 11. The mechanism provides more varied configurations and more flexible adjustments.

In each of the disclosed embodiments, the second outer casing 4 is preferably configured for insert into the barrel of the firearm to locate the locking component 11 at the firearm's chamber. If the second outer casing 4 approaches or reaches the bottom of the chamber, and the trigger of the firearm is accidentally activated, the firing pin could hit against the end of the second outer casing 4, potentially breaking the firing pin. To guard against this problem, the free terminal end of the second outer casing 4 is preferably configured to form a port defining a through hole, which is preferably blocked by a cushioning member formed of nylon, plastic, or other suitably flexible material.

The second outer casing 4 may have a circular, polygonal, or other suitable sectional contour. The housing wall of the second outer casing 4 may be solid or hollow. For example, the second outer casing may be of a hollow cylindrical solid or a hollow polygonal body structure. In addition, the wall of the hollow cylindrical or polygonal body may be hollowed out.

The inner surface of the second outer casing 4 may further include a positioning unit for stopping the rotation of the locking component such that the long axis of the locking component 11 extends substantially in parallel with the long axis direction of the second outer casing 4 in the unlocked state. The portion of the locking component 11 where it contacts the positioning unit may be formed with a notch that matches the positioning unit.

Further, the outer casing, the push rod, the connecting rod, and the locking component are preferably made of metal or any other suitable material known in the art which provides sufficient strength, rigidity, and toughness to carry out effective gun lock operation in the particularly intended application. In certain preferred embodiments, for example, the push rod, the connecting rod and the outer casing are made of stainless steel material, and the locking component is made of aluminum material.

In each of the first embodiment and third embodiments, when both ends of the rotation shaft are fixed to the second outer casing, to avoid the locking component swinging on the rotation shaft, one or more suitable fixing devices may be installed at two sides of the locking component for blocking its movement on the rotation shaft. This may include, for example, use of a pin or a tiny padding element as a fixing unit.

In each of the first, second, and third embodiments, the first outer casing includes: two or more buttons connected to the control device for issuing a lock command or an unlock command, where the unlocking command is issued in the form of an input password. In the unlocked state, if any button is pressed, it will trigger a lock command; in a locked state, an unlock command is issued by pressing a combination of the two or more buttons to provide correct password. In order to aid the user in distinguishing between buttons when entering the password, multiple buttons are identified by different distinctive markers. For example, if two buttons are used for input, the shape of one button may be a circle, the other a square. Alternatively, one button may form a convex structure, and the other a concave structure.

In an application environment using two or more push-buttons, incrementally raised protrusions may be formed on the surface of the buttons. For example, the first button is provided with one small circular protrusion on the surface, the second button is provided with two small circular protrusions on the surface, and the third button is provided with three small circular protrusions on the surfaces, and so on. This makes it very convenient for the user of the firearm to enter a "blind" password. Even in a dark environment or where the buttons otherwise cannot be seen, the password can be quickly entered to issue an unlock command.

Additionally, the first outer casing may further include in certain embodiments: an indicator light, and/or a display screen. The indicator light or display provides visual indication of the current status of the gun lock. Two or more indicator lights may be employed, for instance, to indicate various information through different indicator light color combinations and/or through different flash combinations. Information such as display unlock status, lock status, password setting status, password input error, low battery information, or the like may be indicated in this manner.

The outer shape of the first outer casing is preferably set to approximate or match the shape of the muzzle of the firearm to be locked. A locked firearm may then still fit into the holster with the gun lock in place in its locked state.

Figure 13:
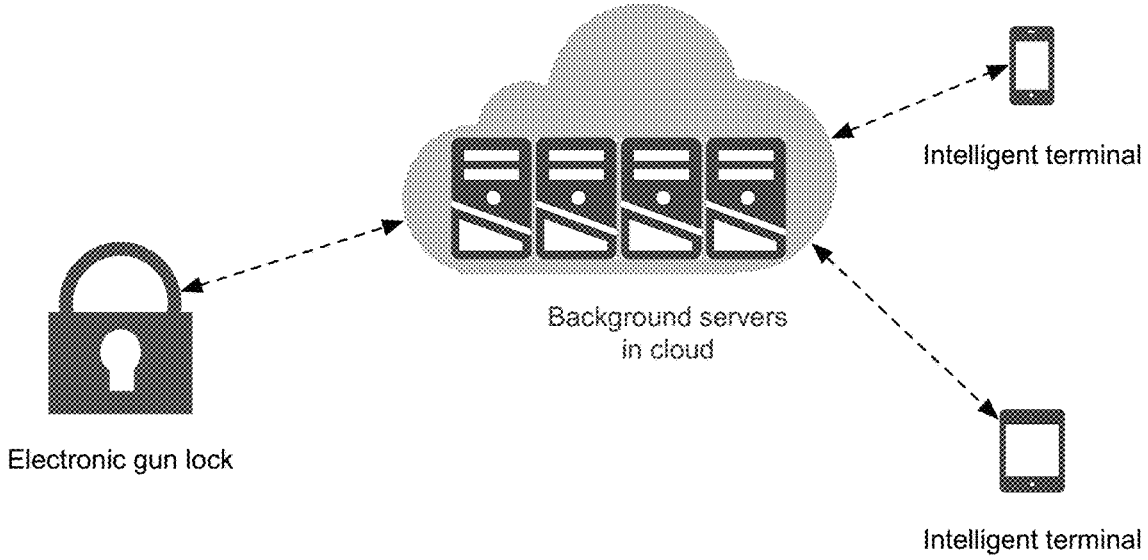
FIG. 13 is a schematic diagram of a system formed in accordance with an exemplary embodiment of the present invention, illustratively shown linked by a communications network for communication with a background server and an intelligent mobile terminal; and, FIG. 14 is a schematic circuit block diagram of a portion of the system formed in accordance with an exemplary embodiment of the present invention, illustrating certain functional interconnections for controlling a linear motor.

The electronic gun lock may in certain embodiments further include: a communication component connected to the control device suitably configured to establish a network communication link with one or more background devices to implement remote unlocking, prohibiting unlocking, modifying a password function, and performance monitoring and etc. Background devices may include a server or a smart mobile terminal, such as a smart phone, a tablet, or the like. FIG. 13 is a schematic diagram illustrating use of an electronic gun lock system provided in accordance with an exemplary embodiment of the present invention, as connected for communication with one or more background servers and intelligent mobile terminals through a network.

Moreover, the electronic gun lock may further include a positioning device for detecting and transmitting its geographical position to the background devices. The positioning device may include a GPS positioning chip, a Beidou positioning chip, or any other suitable navigation or location sensing measures known in the art.

Additionally, the electronic gun lock may further include: a vibration sensor, a pressure sensor, and/or a temperature and humidity sensor. A vibration sensor is configured to sense the movement of the electronic gun lock. When the mobile monitoring mode is turned on, and an individual touches and moves the electronic gun lock, especially when the gun lock has locked the firearm, such vibration sensor activates to convert the monitored movement signal into an electrical signal and transmits the same to the designated background device(s) through the communication component. A pressure sensor is coupled to the locking component to detect contact of the locking component with the chamber or other inner surface of the firearm.

A temperature and humidity sensor is configured to collect temperature and humidity measures of the electronic gun lock's ambient environment. The detected temperature and humidity of the environment provides reference Information to facilitate optimal storage and management of the firearm.

Figure 14:
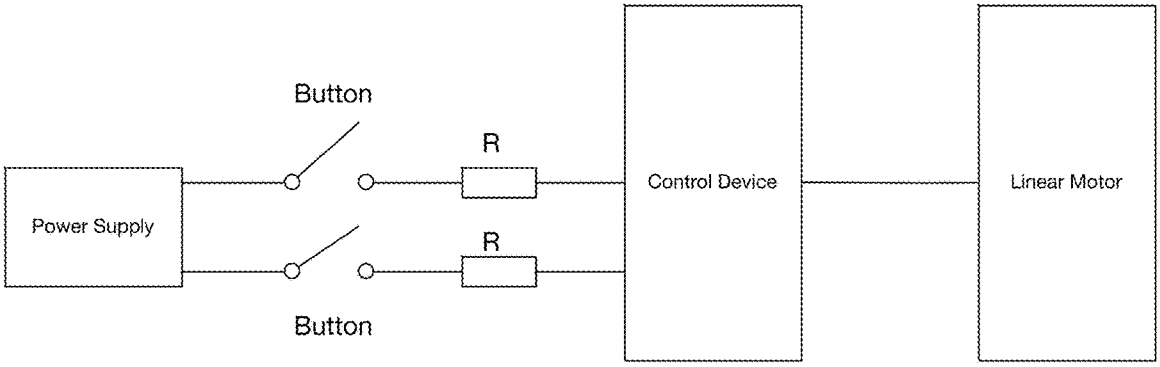

Regarding the control device in the electronic gun lock, its main function is to receive electric signal commands sent in response to the buttons, identify the command content, and generate a suitable control signal for the linear motor to properly drive the push rod—such as to move straight forward or straight backward. By way of illustration, one end of the button is connected to a power source through a voltage dividing resistor, and the other end of the button is connected as shown in FIG. 14 to an input end of the control device. In a normal state, the button is disconnected. But when the user presses the button to its closed state, a circuit is activated between the power source, voltage dividing resistor, button, and the input end of the control device. An electrical signal is thereby applied to the input terminal. The output of the control unit is connected to a linear motor.

The control device can be implemented by a microprocessor based chip that provides control functions. The chip has internal components such as CPU, running memory and data storage/memory space. A suitably configured control program, current password, and system configuration settings are suitably stored in the storage space of the chip.

The control device of the electronic gun lock system generally provides three basic functions: locking, unlocking, and a password setting/resetting.

Regarding the locking function, in the unlocked state, pressing or otherwise manipulating any of the plurality of buttons on the first outer casing serves to send a responsive electrical signal to the control device. After receiving the electrical signal, the control device sends a control signal(s) to the IC of linear motor driver, which directs the linear motor to finish the requested movement. The detailed process of rotating the locking component to complete the locking function during the operation of the linear motor has been described in detail above and is not repeated here.

Regarding the unlocking function of the electronic gun lock system, in order to unlock, user needs to input the correct password by pressing the buttons of the first outer casing. In the stream of user's inputs, if any continuous subset of current input stream matches the correct password, an unlock instruction is immediately triggered by sending a responsive control signal(s) to the linear motor which performs the unlock operation.

The benefits of the unlocking operation as carried out by the system include the following. In the process of inputting a password, even if one or more entries are made incorrectly in the middle, users are not required to delete previous incorrect inputs or press a cancel key to clear the already entered input streams. Instead, users may simply start re-inputting the correct password at any point with no stop, which speeds up the unlock process.

For example, for convenience of description, it is assumed that there are two input buttons on the first outer casing, and one of the buttons indicates input "A," while the other button indicates input "B." If the user simultaneously presses the two buttons, an input "C" is indicated. Furthermore, assume the unlock password stored in the control device is "ABACBC." When the user wishes to enter the password "ABACBC," but accidentally enters an incorrect button in the middle, an incorrect password is entered. Consequently, the user has entered "ABAB" or "ABACC" and etc. According to the unlocking method as carried out in accordance with one exemplary embodiment of the present invention, when the user enters inputs "ABAB," user may continue to input the correct password, by restarting the correct password's entry immediately from that point, without first having to delete the incorrect password portions previously entered. For example, the final input stream may be like "ABABABACBC," in includes the combination of incorrect input "ABA" plus the correct password "ABACBC." The software executed by the gun lock system is able to find the correct inputs and trigger the unlock operation.

In another example, when the user inputs "ABACC" which is an incorrect password, the user may simply continue to input the correct password sequence "ABACBC." That is, the stream of entries may total "ABACCABACBC," which is acceptable for entry of the correct password. The control device compares the password entry sequences "ABABABACBC" or "ABACCABACBC" entered by the user with the correct password "ABACBC" stored internally and tries to find the correct password from the end of each input stream. In the input streams "ABABABACBC" and "ABACCABACBC" in which the user has pressed two buttons several times in succession, because there is a sub-stream at the end of whole input stream that matches the correct password "ABACBC," the input is accepted as providing the correct password to trigger the unlock process.

In order to prevent tampering of locked guns and the persistent entry of various combinations of passwords in an attempt to 'hack' the gun lock, the number of attempts or time of pressing input buttons may be suitably limited as needed for the requirements of the particularly intended application. When the maximum number of attempts or maximum elapsed time has been exceeded, the gun lock is completely locked and cannot be unlocked thereafter by normal password entry. In that case, extraordinary security/control measures such as access by only those having prescreened advanced permissions to unlock would be needed to reset the gun lock system for normal operation.

A password setting function executed by the electronic gun lock system operates in one exemplary embodiment of the present invention as follows. In the unlocked state, pressing any two of the plurality of buttons simultaneously activates a control mode. The process of modifying a password includes a user first inputting the password reset command by pressing two or more of the buttons in the control mode. The user then enters a separator instruction by pressing the two or more buttons, and thereafter entering the original password by pressing two or more of the buttons. Next, the user enters a separator command by pressing two or more of the buttons, then inputs a new password by also pressing two or more of the buttons. Finally, the user presses two or more of the buttons to input a completion command. At each of these processes, the user preferably enters a distinct combination and/or sequence of buttons to activate a corresponding action or command.

The following is a specific case to explain the password setting function. For convenience of description, it is assumed that two buttons are provided on the first outer casing, one of the buttons being pressed to indicate the input "A," the other button being pressed to indicate the input "B," and the two buttons being pressed simultaneously to indicate the input "C." In this example, as shown in Table 1, it is assumed for example that input sequence "CCCC" enters the control mode, then input sequence "AABBCC" issues a modify password command, after which input sequence "CC" provides a separator command. After that, an original password, such as "ABACBC," is entered before "CC" is again entered to issue a separator command. Then a new password, such as "ABAACB," is entered. Finally, input sequence "CCC" is entered to issue a completion command, indicating the end of the operation. An operation to modify/reset the password is thereby implemented.

TABLE 1

| CCCC | AABBCC | CC | Original password | CC | New password | CCC |
|---|---|---|---|---|---|---|
| Enter control mode | Change password command | separator command | | separator command | | completion command |

In addition to the password setting operation described above, the following may operations may also be included to help confirm the new password. After pressing two or more of the buttons to input a new password, two or more of the buttons are pressed to input a separator command, and then two or more buttons are pressed to re-enter the same new password. After that, two or more of the buttons are pressed to input the completion command.

In conjunction with Table 2, continuing with the above example, after entering a new password such as "ABAACB," the user may enter "CC" to issue a separator command, and then enter the same new password "ABAACB" for password confirmation, and finally enter "CCC" to issue a completion command indicating the end of the operation. A modification setting operation for the password may be thereby implemented.

TABLE 2

| CCCC | AABBCC | CC | Original password | CC | New password | CC | New password | CCC |
|---|---|---|---|---|---|---|---|---|
| Enter control mode | Change password command | Separator command | | separator command | | separator command | | completion command |

Assuming that an administrator or other person who has forgotten the current password for the gun lock system (the original password), a factory reset operation may be provided as back up to restore the current password (original password) to the factory default password. For example, after entering the control mode, "ABABAC" is entered to issue the factory reset command. The current version of the original password is then immediately changed to the factory default password. Normal operation may continue thereafter according to the above password setting method to implement password reset. The factory default password may be set to a simple and easy to remember password before the electronic gun lock system is shipped. Of course, since the factory default password of the same batch or different batches of the electronic gun lock may be the same, it is unlikely that a controller or other personnel of the electronic gun lock system would forget or have difficulty ascertaining the factory-set password.

In accordance with the related description of the present invention, the hardware and software combination required to implement the control device in the electronic gun lock system to execute the various operations disclosed herein will be readily apparent to those skilled in the art. In addition, regarding the communication function, the positioning function, the information status display of the indicator light or the display screen, and the realization of remote unlocking, remotely prohibiting unlocking, the remote password changing function, and the remote performance monitoring function, those skilled in the art will readily recognize that various suitable measures to implement the same are known in the art. These and other measures known in the art which may be employed for implementing the various operations, functions, and methods disclosed herein by use of hardware and software combination are not described in detail herein for that reason.

Although this invention has been described in connection with specific forms and embodiments thereof, it will be appreciated that various modifications other than those discussed above may be resorted to without departing from the spirit or scope of the invention as defined in the appended claims. For example, functionally equivalent elements may be substituted for those specifically shown and described, certain features may be used independently of other features, and in certain cases, particular locations of the elements or processes may be reversed or interposed, all without departing from the spirit or scope of the invention as defined in the appended claims.

What is claimed is:

1. A system for keyless locking of a firearm against discharge, comprising:

a casing configured for removable insert into a barrel of the firearm;

an extension rod disposed in longitudinally displaceable manner in said casing, said extension rod having first and second ends and an intermediate portion extending longitudinally therebetween;

a locking component supported by said casing to be displaceable responsive to said extension rod between locked and unlocked positions relative said casing; and, a powered driver coupled to said extension rod for selectively driving the displacement thereof responsive to user activation;

wherein said locking component in the locked position protrudes transversely beyond said casing for retentively engaging an inner surface of the firearm to prevent removal of said casing from the barrel of the firearm, and said locking component in the unlocked position is retracted to maintain clearance from the inner surface of the firearm to permit removal of said casing from the barrel of the firearm;

wherein said locking component is supported by said casing to be angularly displaceable between the locked and unlocked positions;

wherein said locking component is coupled to the casing through a rotation shaft, said locking component being pivotally displaceable about an axis defined by said rotation shaft, said locking component including a positioning unit for limiting the displacement of a connecting rod coupled thereto for driving linkage with said extension rod.

2. The system as recited in claim 1, wherein said rotation shaft is rotatably coupled to said casing, said locking component being pivotally displaceable with said rotation shaft about the axis defined thereby.

3. The system as recited in claim 1, wherein said rotation shaft is non-rotatably coupled to said casing, said locking component being coupled in pivotally displaceable manner to said rotation shaft for displacement about the axis defined thereby.

4. The system as recited in claim 1, wherein said connecting rod extends between the second end of said extension rod and said locking component, said connecting rod transmitting longitudinal displacement of said extension rod to said connecting rod for angular displacement responsive thereto.

5. The system as recited in claim 4, wherein:

said positioning unit includes a concave surface portion defining first and second stopping surfaces transversely offset from one another in angular orientation;

said connecting rod is inclined in orientation relative to said extension rod, said connecting rod being pivotally coupled to said locking component at the concave surface portion;

the first and second stopping surfaces of said locking component alternatively bearing against opposite sides said connecting rod when said locking component is disposed in the locked and unlocked positions; and, said extension rod is formed with a recessed surface for receiving an end of the said connecting rod therein.

6. The system as recited in claim 1, wherein said powered driver includes a linear motor coupled to the first end of said extension rod, said linear motor executing to drive reciprocal longitudinal displacement of said extension rod.

7. The system as recited in claim 6, wherein said linear motor is disposed within a first outer portion of said casing and said extension rod is disposed within a second outer portion of said casing, the first outer portion of said casing being configured to remain outside the barrel of the firearm and the second outer portion of said casing being configured to extend coaxially into the barrel of the firearm when the system is installed to lock the firearm.

8. The system as recited in claim 1, further comprising a control device coupled to actuate said powered driver responsive to user activation, said control device executing a processor to selectively issue control commands to said powered driver for driving said locking component between the locked and unlocked positions, said control device being configured for network communication with a remotely disposed device.

9. The system as recited in claim 8, wherein said control device maintains secure access control, said control device being configured to selectively execute control commands including: a locking command, an unlocking command, an unlocking password setting command, and a password resetting command.

10. A system for keyless locking of a firearm against discharge, comprising:

a casing configured for removable insert into a barrel of the firearm, said casing including:

a first outer portion configured to remain outside a barrel of the firearm when the system is installed to lock the firearm; and, a second outer portion configured to extend coaxially into the barrel of the firearm when the system is installed to lock the firearm;

an extension rod disposed in axially displaceable manner substantially within the second outer portion of said casing, said extension rod having first and second ends and an intermediate portion extending axially therebetween;

a locking component supported by said casing to be displaceable responsive to said extension rod between locked and unlocked positions relative said casing;

a powered driver disposed in the first outer portion of said casing and coupled to the first end of said extension rod for selectively driving displacement thereof; and, a control device coupled to actuate said powered driver responsive to user activation, said control device executing a processor to selectively issue control commands to said powered driver for driving said locking component between the locked and unlocked positions, said control device being configured for network communication with a remotely disposed device;

wherein said locking component in the locked position protrudes transversely beyond said casing for retentively engaging an inner surface of the firearm to prevent removal of said casing from the barrel of the firearm, and said locking component in the unlocked position remains transversely within a periphery of said casing for clearance from the inner surface of the firearm to permit removal of said casing from the barrel of the firearm;

wherein said locking component is coupled to the casing through a rotation shaft, said locking component being angularly displaceable about an axis defined by said rotation shaft between the locked and unlocked positions, said locking component in the locked position protruding through an opening formed in the second outer portion of said casing.

11. The system as recited in claim 10, further comprising at least one connecting rod extending between the second end of said extension rod and said locking component to transmit the axial displacement of said extension rod to said connecting rod for angular displacement responsive thereto, said connecting rod being pivotally coupled to the second end of said extension rod and said locking component.

12. The system as recited in claim 11, wherein:

said locking component is formed with a concave surface portion defining first and second stopping surfaces angularly offset from one another, and said connecting rod is pivotally coupled to said locking component at the concave surface portion, the first and second stopping surfaces of said locking component alternatively bearing against opposite sides of said connecting rod when said locking component is disposed in the locked and unlocked positions; and, said powered driver includes a linear motor coupled to the first end of said extension rod, said linear motor executing to drive reciprocal axial displacement of said extension rod.

13. The system as recited in claim 10, wherein said control device maintains secure access control, said control device being configured to selectively execute control commands including: a locking command, an unlocking command, an unlocking password setting command, and a password resetting command.

14. A method for keyless locking of a firearm against discharge, comprising:

establishing a casing having first and second outer portions;

removably installing the casing from outside the firearm by coaxially inserting the second outer portion thereof into a barrel of the firearm, with the first outer portion thereof remaining outside the barrel of the firearm;

axially displacing an extension rod disposed substantially within the second outer portion of said casing, said extension rod having first and second ends and an intermediate portion extending axially therebetween;

displaceably supporting a locking component on said casing to be displaceable responsive to displacement of said extension rod between locked and unlocked positions relative said casing;

activating a powered driver disposed in the first outer portion of said casing to selectively drive axial displacement of said extension rod for actuating displacement of said locking component responsive thereto between the locked and unlocked positions; and, selectively controlling access for activation of said powered driver;

wherein said locking component in the locked position is arranged to protrude transversely beyond said casing for retentively engaging an inner surface of the firearm and thereby preventing removal of said casing from the barrel of the firearm, and said locking component in the unlocked position is arranged to remain transversely within a periphery of said casing for clearance from the inner surface of the firearm and thereby permit removal of said casing from the barrel of the firearm;

wherein said locking component is coupled to the casing through a rotation shaft to be angularly displaceable about an axis defined by said rotation shaft between the locked and unlocked positions, said locking component in the locked position being arranged to protrude through an opening formed in the second outer portion of said casing.

15. The method as recited in claim 14, further comprising maintaining network communication access for said control device to establish a communication link with a remotely disposed device, and configuring said control device to selectively execute control commands including: a locking command, an unlocking command, an unlocking password setting command, and a password resetting command.

16. The method as recited in claim 14, further comprising linking the second end of said extension rod to said locking component through at least one connecting rod extending therebetween for transmitting the axial displacement of said extension rod to said connecting rod for angular displacement responsive thereto, wherein:

said extension rod is driven to reciprocally push and pull said connecting rod for reciprocally swinging a portion of said locking component about the axis of said rotation shaft;

a concave surface portion is formed in said locking component to define first and second stopping surfaces angularly offset from one another; and, said locking component is limited in range of angular displacement by the first and second stopping surfaces thereof alternatively bearing against opposite sides of said connecting rod when disposed in the locked and unlocked positions.

* * * * *